US008556542B2

(12) United States Patent
Horsch et al.

(10) Patent No.: US 8,556,542 B2
(45) Date of Patent: Oct. 15, 2013

(54) CUTTABLE DRILLING TOOL, AND A CUTTABLE SELF DRILLING ROCK BOLT

(75) Inventors: John Horsch, New South Wales (AU); Simon Daniel Hardwicke Knight, New South Wales (AU)

(73) Assignee: Sandvik Intellectual Property AB, Sandviken (SE)

( * ) Notice: Subject to any disclaimer, the term of this patent is extended or adjusted under 35 U.S.C. 154(b) by 222 days.

(21) Appl. No.: 12/990,875

(22) PCT Filed: Apr. 24, 2009

(86) PCT No.: PCT/SE2009/050434

§ 371 (c)(1), (2), (4) Date: Jan. 10, 2011

(87) PCT Pub. No.: WO2009/157846

PCT Pub. Date: Dec. 30, 2009

(65) Prior Publication Data

US 2011/0103896 A1 May 5, 2011

(30) Foreign Application Priority Data

Jun. 25, 2008 (AU) ..... 2008904475
Oct. 17, 2008 (AU) ..... 2008230002

(51) Int. Cl.
*E21D 21/00* (2006.01)
*E21B 17/00* (2006.01)

(52) U.S. Cl.
USPC ..... 405/259.1; 405/258.1; 175/325.2; 285/256; 285/382

(58) Field of Classification Search
USPC ..... 405/259.1–259.6; 175/320, 325.2; 285/256, 382
See application file for complete search history.

(56) References Cited

U.S. PATENT DOCUMENTS

| | | | | |
|---|---|---|---|---|
| 5,443,099 | A * | 8/1995 | Chaussepied et al. | 138/109 |
| 5,865,571 | A * | 2/1999 | Tankala et al. | 408/1 R |
| 6,352,391 | B1 * | 3/2002 | Jones | 405/252.1 |
| 2008/0038068 | A1 * | 2/2008 | Craig | 405/259.3 |

FOREIGN PATENT DOCUMENTS

| | | |
|---|---|---|
| GB | 860768 | 2/1961 |
| GB | 2 106 608 | 4/1983 |
| GB | 2 258 899 | 2/1993 |

* cited by examiner

*Primary Examiner* — David Bagnell
*Assistant Examiner* — Carib Oquendo
(74) *Attorney, Agent, or Firm* — Morgan, Lewis & Bockius LLP

(57) ABSTRACT

The present invention relates to a drilling tool incorporating first and second ends, a cuttable and/or processable shaft extending between the ends. The first end has a drill bit to penetrate rock. The drill bit and the shaft have complementary threads. The drill bit and the shaft comprise a relative rotation stop means that ensures that the drill bit remains loose during drilling in a first direction. The invention further relates to a self drilling rock bolt, a drill bit, drill shaft and shaft coupling, and an anchoring device per se.

14 Claims, 12 Drawing Sheets

SECTION A-A

CUTTABLE DRILLING TOOL, AND A CUTTABLE SELF DRILLING ROCK BOLT

CROSS-REFERENCE TO RELATED APPLICATIONS

This application is the National Stage of International Application No. PCT/SE2009/050434, filed Apr. 24, 2009, and claims benefit of AU Application No.'s 2008904475, filed Jun. 25, 2008 and 2008230002, filed Oct. 17, 2008.

FIELD OF THE INVENTION

The present invention relates to drilling tools and rock bolts suitable for use in the mining and tunnelling industry to provide roof and wall support. The invention is suitable for use in hard rock applications as well as in softer strata, such as that often found in coal mines, and it is to be appreciated that the term "rock" as used in the specification is to be given a broad meaning to cover both these applications.

BACKGROUND OF THE INVENTION

Roof and wall support is vital in mining and tunnelling operations. Mine and tunnel walls and roofs consist of rock strata, which must be reinforced to prevent the possibility of collapse. Rock bolts are widely used for consolidating the rock strata.

In conventional strata support systems, a hole is drilled into the rock by a drill rod, which is then removed and a rock bolt is then installed in the drilled hole and secured in place typically using a resin or cement based grout.

To improve this process, self drilling rock bolts have been proposed whereby the bolt is also used as the drill rod. As such, with a self drilling rock bolt, the hole can be drilled and the bolt installed in a single pass.

Whilst self drilling rock bolts provide the opportunity to substantially improve installation times of rock bolts, they have not been widely used, especially if the strata they are installed in subsequently requires processing.

SUMMARY OF INVENTION

In accordance with a first aspect of the present invention, there is provided a shaft of a drilling tool extending between opposing ends, one of the ends being associated with a drill bit to penetrate rock, the other end being associated with a drilling apparatus to allow rotation of the shaft, the shaft comprising:

a shaft section having opposing shaft section ends, the shaft section being arranged to be cut and/or processed by a mining machine; and a connector piece attached adjacent one of the shaft section ends, the connector piece being arranged to connect one of the drill bit, the drilling apparatus or an anchoring device to the shaft section.

Some embodiments provide the advantage that a mine can be developed, especially at a long-wall mining site, using cuttable drilling tools or rock bolts that are left in the strata, and then the strata containing the tool/bolt can be cut away and/or processed by a mining machine without damaging or jamming the machine.

The use of a composite shaft as described above allows different parts of the shaft to have different properties. For example, the ends of the shaft or connectors may be formed of a machinable and strong material suitable for a coupler, but the shaft section may be formed of an easily cuttable material.

In an embodiment, the shaft section comprises a glass reinforced polymer portion.

Glass reinforced polymer is often advantageous to use because it is easily cut by the tools on the mining machine, and relatively easily broken during processing of the mined material including the cut tool/bolt. It is however, very strong in tension and thus suitable for this application.

In an embodiment, the connector piece comprises metal and is secured to the shaft section by a deformable member swaged, crimped and/or pressed around both the connector piece and the shaft section. The deformable member may extend further along the shaft section than the connector piece.

In an embodiment, the connector piece comprises a deformable member swaged, crimped, and/or pressed around the shaft section for securement of the connector piece to the shaft section. The connector piece may comprise metal. The shaft section may be shaped to provide a mechanical interference between the shaft section and the deformable member. The deformable member may be integrally formed with the connector piece.

The use of a deformable member in a crimp type connection is advantageous because it allows a shaft comprising dissimilar materials to be formed.

In an embodiment, the connector piece is fitted and/or moulded over a portion of the shaft section. The connector piece may be a polymer. The portion of the shaft section may be shaped to provide a mechanical interference between the shaft section and the connector piece. The connector piece may have an external thread. The external thread may be a rope thread.

An over-molded connector is often advantageous because it allows rapid and relatively cheap production. It also allows a wide variety of connector shapes and configurations.

In an embodiment, the shaft section comprises a conduit running along the length of the shaft section, the conduit opening out at ends of the shaft section.

According to a third aspect of the invention there is provided a connector piece having opposing ends, one end being arranged to be attached adjacent to an end of a shaft of a drilling tool, the other end being arranged to connect to one of a drill bit, a drilling apparatus to allow rotation of the shaft, or an anchoring device.

In an embodiment, the connector piece comprises a deformable member arranged to be swaged, crimped, and/or pressed around the shaft section for securement of the connection piece to the shaft section. Alternatively, the connector piece includes a connector piece comprises a threaded surface arranged to engage a corresponding threaded surface of the shaft.

In accordance with a fourth aspect of the invention there is provided a drilling tool comprising a shaft according to the first aspect of the invention.

In an embodiment, the drilling tool is a self drilling rock bolt. The rock bolt may be arranged for bolting a coal face in a long-wall mining operation. The mining machine may comprise a shearer or power loader.

In accordance with a fourth aspect of the invention, there is provided a self drilling rock bolt comprising a shaft extending between opposing ends, the shaft comprising a shaft section located between the ends arranged to be cut and/or processed by a mining machine, and an anchoring device extending along a first part of the shaft adjacent one of the ends.

In an embodiment the anchoring device has an internal thread that cooperates with an external thread on a connector fitted and/or moulded over a portion of the shaft section, the first part of the shaft having a drill bit to penetrate rock during drilling in a first direction and a stop to limit the rotation of the anchoring device on the shaft to maintain the anchoring device in loose threaded connection on the shaft during drilling.

BRIEF DESCRIPTION OF THE FIGURES

It is convenient to hereinafter describe embodiments of the present invention with reference to the accompanying drawings. The particularity of the drawings and the related description is to be understood as not superseding in generality of the preceding broad description of the invention.

In the drawings:

FIG. 78 is a perspective view of the first end of the drilling tools of FIGS. 1-4;

DETAILED DESCRIPTION OF EMBODIMENTS OF THE INVENTION

Figure 1:
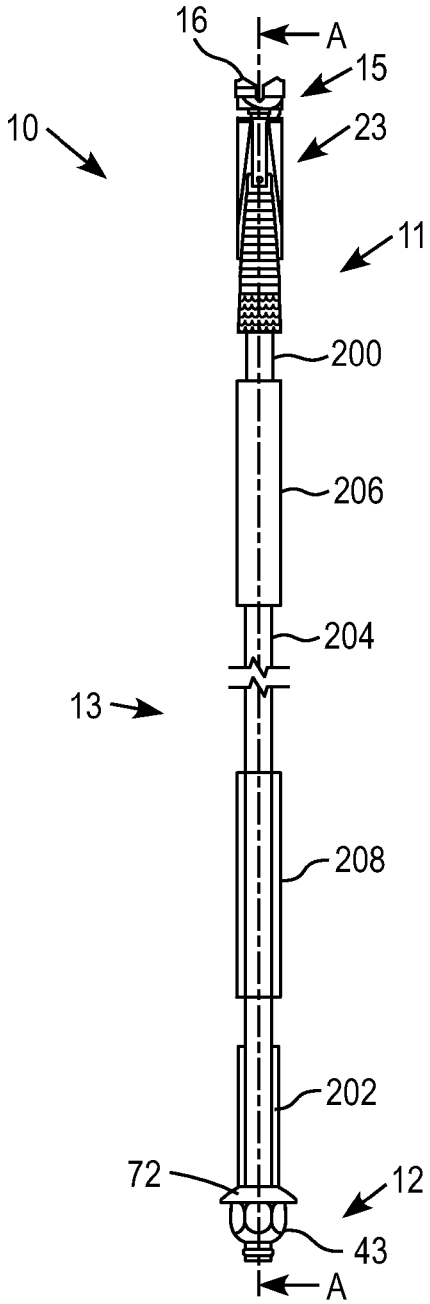
FIGS. 1 and 2 are side elevational and sectional views of one embodiment of a drilling tool.
Figure 2:
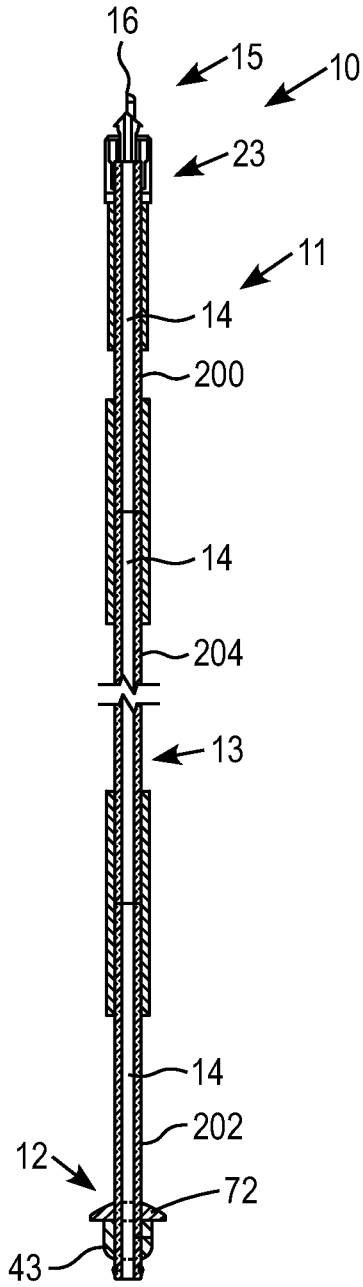
Figure 8:
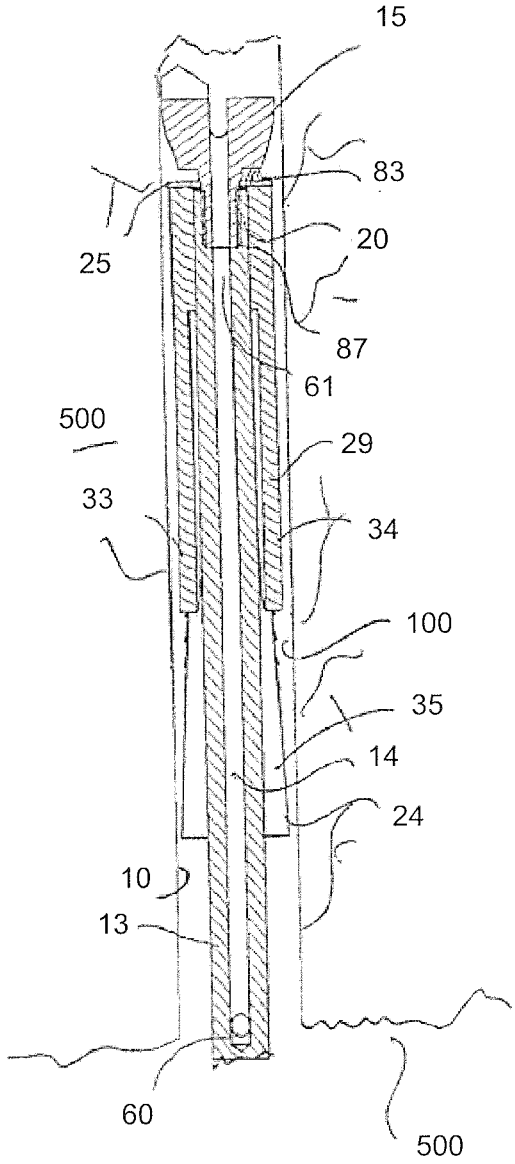
FIG. 8 is a sectional view of the first end of the drilling tools of FIGS. 1-4 when located in rock strata.
Figure 12:
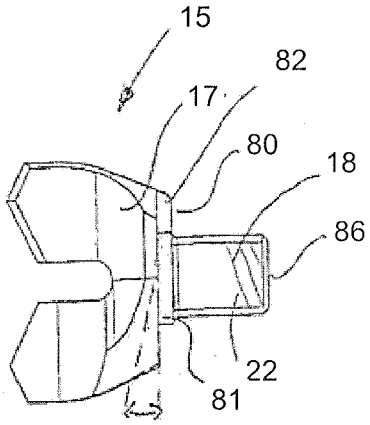
FIG. 12 is a side view of a drill bit of the drilling tools of FIG. 1-4.
Figure 11:
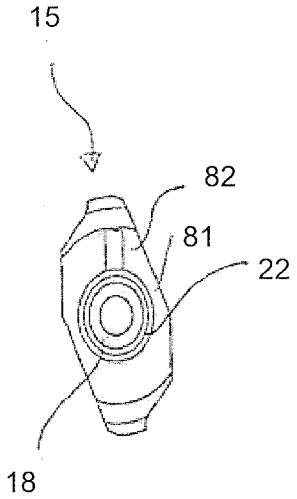
FIG. 11 is a bottom view of a drill bit of the drilling tools of FIG. 1-4.

FIGS. 1 and 2 illustrates one embodiment of a self drilling rock bolt 10 which incorporates a first (drilling) end 11 and a second (nut) end 12 and a shaft 13 which extends between the opposite ends 11, 12. The shaft 13 is a composite shaft comprising connector pieces 200,202 and a shaft section 204 arranged to be cut and/or processed by a mining machine such as a shearer in a long-wall mining operation. The shaft section of this embodiment is fabricated from a glass reinforced plastic (GPP) material which is cuttable and compatible with the mining machine and is unlikely to damage or jam it. In this embodiment, the shaft section 204 is formed of an E glass and polyester resin GRP. Other suitable resins include vinylester. The plasticity of the hardened resin spreads the tensile stress evenly over a large number of glass fibres. The shaft 13 incorporates an inner passage or conduit 14 (also see FIG. 9) along at least a distal (first) part of the bolt 10 adjacent the drilling end 11. The inner passage 14 communicates with the exterior of the shaft at two places as shown in FIG. 8; though a lateral port 60, and through an end port 61.

In use, the connector piece 202 of the self drilling rock bolt 10 is connected to a drilling and bolting apparatus (not shown) and acts as a drill rod to drill a hole 100 (see FIG. 9) into rock strata 500. Thereafter, the rock bolt 10 is secured in place as will be explained in more detail below to provide support for the rock strata 500.

The drilling end 11, connected to the shaft 13 by another connector piece 200, incorporates a drill bit 15 incorporating a drill tip 16 at an end thereof and an anchoring device 23 which in use is arranged to retain the bolt in a drilled hole. The anchoring device 23 extends along the first part of the bolt 10 and is used to retain the bolt 10 in the drilled hole so as to temporarily secure the rock bolt in place prior to the introduction of grout into the hole 100 to permanently fix the bolt 10 in place and/or to tension the bolt 10 so as to place the rock strata 500 in compression.

The connector pieces 200 and 202 are formed of a metal, such as steel, and are secured to the glass fibre reinforced plastic shaft section 204 by the ductile metal members 206 and 208 which are swaged, crimped and/or pressed around both the connector 200, 202 and the shaft section 204. Suitable ductile metals for members 206 and 208 include low carbon steels such as 1010. The member 206, 208 may extend further along the shaft section 13 than the connector pieces 202, 200. This is because the amount of pressure that can be applied to the glass reinforced polymer shaft section 13 is less than the amount of pressure that can be applied to the steel connectors 200, 202 and thus a larger contact surface is required between the polymer shaft section 204 and the connectors 200, 202.

Figure 3:
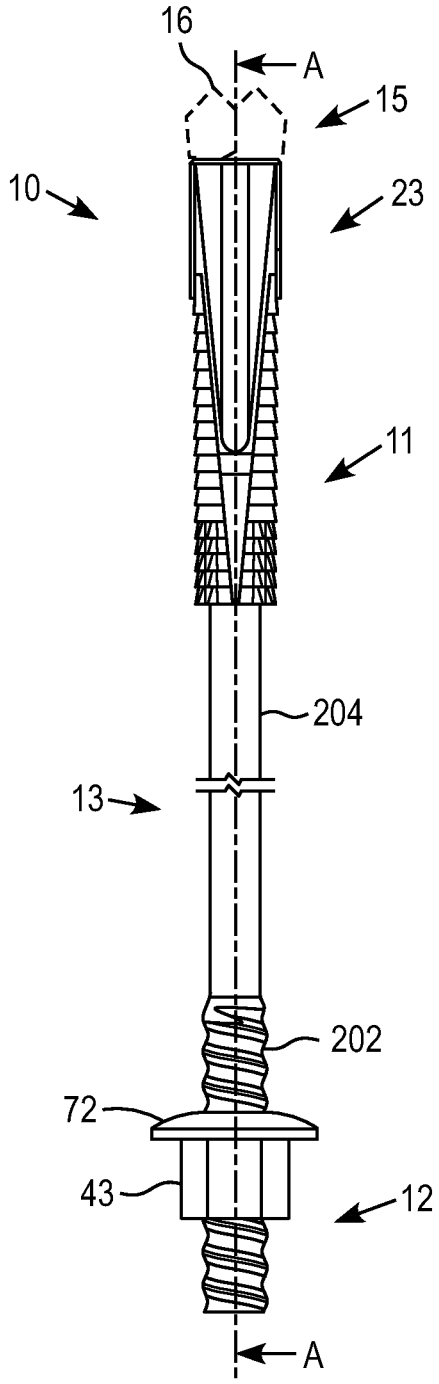
FIGS. 3 and 4 are side elevational and sectional views of another embodiment of a drilling tool.
Figure 4:
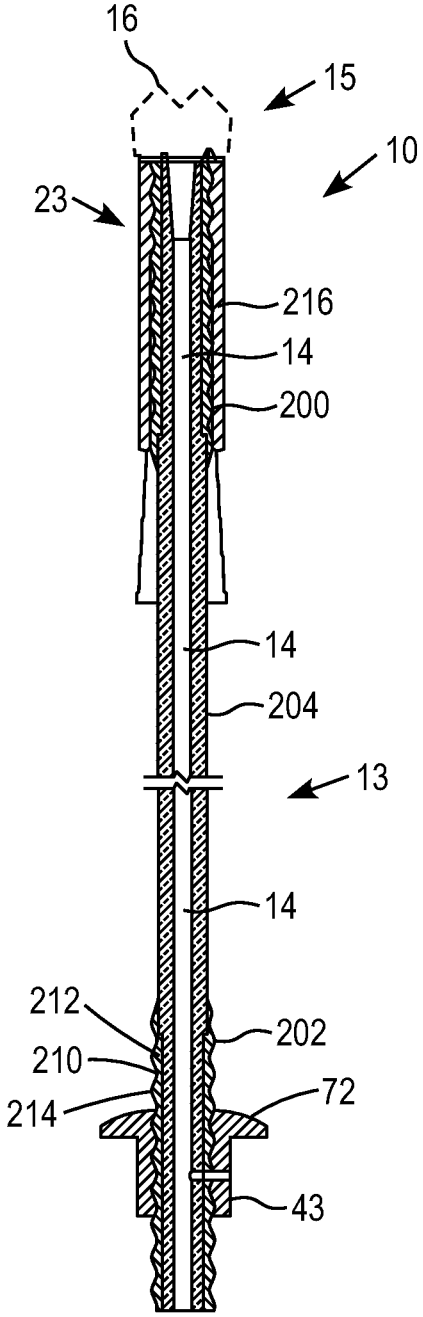
Figure 5:
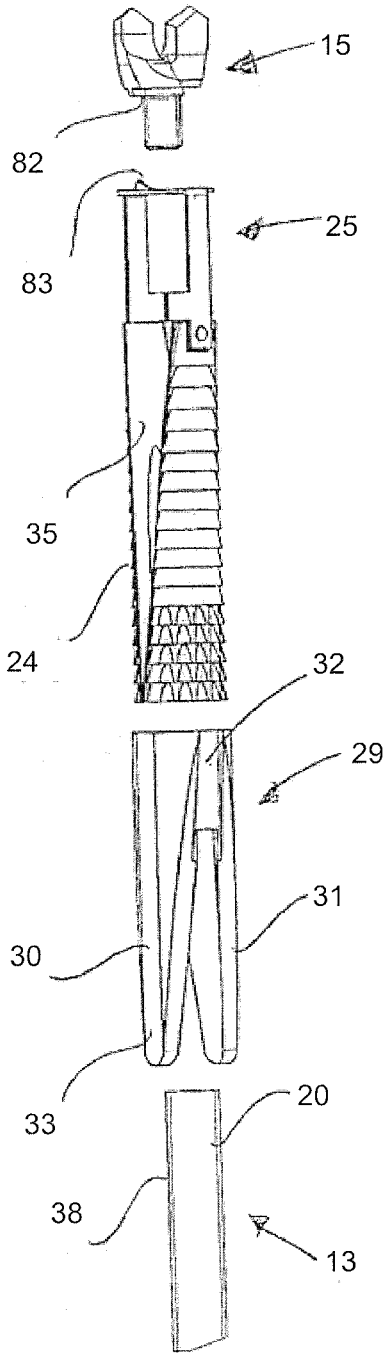
FIG. 5 is an exploded view of a first end of the drilling tools of FIGS. 1-4.
Figure 6:
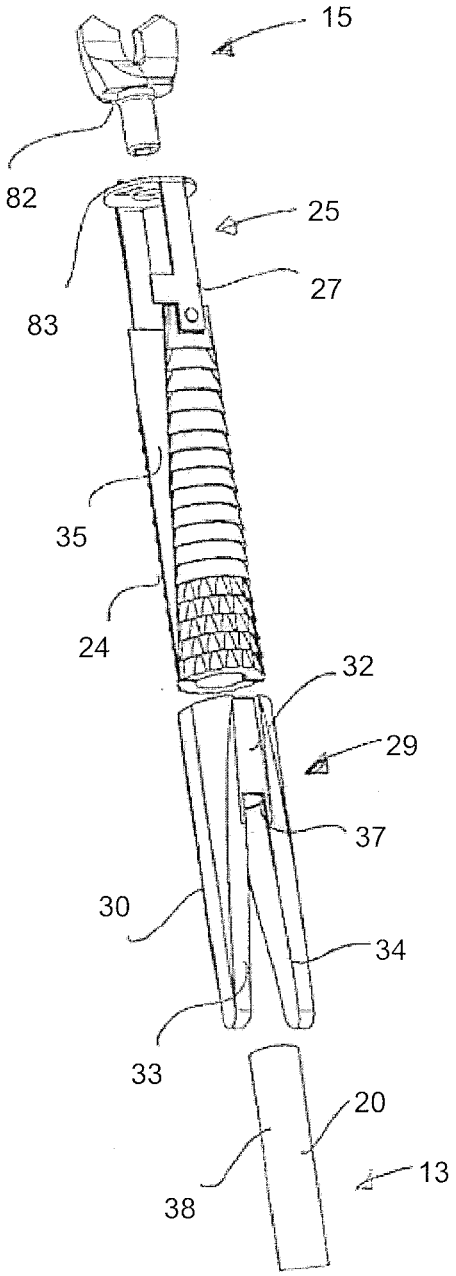
FIG. 6 is another exploded view of the first end of the drilling tools of FIG. 1-4.
Figure 7:
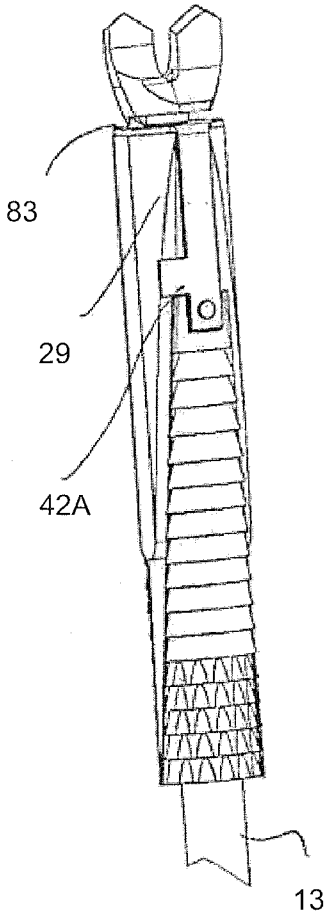

FIGS. 3 and 4 show another embodiment similar to the embodiment shown in FIGS. 1 and 2. Components similar to those in FIG. 1 have been similarly numbered. In this embodiment, the connector pieces 200, 202 are molded over a portion of the shaft section 204. Again the connector may be a polymer. A portion of the shaft section 210 may be shaped to provide a mechanical interference between the shaft section and the molded connector piece 202. In this embodiment, the portion of the shaft section 210 has circumferential grooves such as 212 machined into it. A connector piece 212 has an external rope thread 214 as does the connector piece on the other end 216 of the shaft 13. The circumferential grooves such as 212 may be any shape such as a thread, groove or dimples. Inward rather than outward features such as grooves 212 are preferable because they do not take material away from the connector 212 which would result in a shallower and thus weaker rope thread 214. The rope thread 214 may be machined into the connection 202, 200 with a lathe, for example. The connector pieces 202 and 200 may be made of high density polyethelene, or glass fibre filled Teflon or nylon. Teflon has good friction properties which is desirable in many circumstances. The rope thread 214 is a relatively coarse thread which allows lots of movement of a plate 72 and a nut 43 on the connector 202 per turn. A rope thread is easily moldable as opposed to a V-formed thread which is very difficult to mold because tight crevices are involved in which the liquid polymer typically does not penetrate. A cutting die may then be needed to finish the V-formed thread.

The details of the drilling end 11 are best seen in FIGS. 5 to 12.

During a drilling operation, the drilling apparatus typically induces right hand rotation to the drill shaft. To ensure that the drill bit 15 does not separate from the shaft during the drilling operation, the threaded coupling between the drill bit 15 and the shaft 13 is a right handed thread so as to tend to cause the threaded coupling between the drill bit and shaft to tighten during a drilling operation.

The drill bit 15 includes a bit body 17 which includes the drill tip 16 at its outer end and a drill bit shank 18 which incorporates a fastening means such as an external thread 22 on its outer surface. A passage 19 extends from the distal tip of the shank 18 through to the distal end of the bit body 17. This passage 19 is arranged to be in fluid communication with end port 61 of the inner passage 14 of the shaft when the drill bit 15 is secured to the shaft end 20 (as best seen in FIG. 8). The shaft end 20 includes an inner thread 21 (see FIG. 8) which is complementary to the external thread 22 on the drill bit shank 18. As such, the drill bit 15 can be simply screwed on to shaft end 20 of the shaft 13.

The drill bit 15 is provided with a lower end surface 80 in connection with the drill bit shank 18. The end surface 80 extends substantially perpendicularly to the drill bit shank. The shoulder surface faces towards the shaft 13 when the drill bit has been mounted. The shoulder surface comprises at least one recessed surface 81 that incorporates an upstanding wall 82. The recessed surface 81 is in the illustrated form generally parallel to the lower surface 80 but in another form may be inclined at an acute angle $\alpha$ (shown in FIG. 12) relative to the lower end surface. The magnitude of the angle $\alpha$ needs to be greater than a pitch angle of the external thread formed on the drill shank. The magnitude of the angle $\alpha$ is at least 20% greater than the pitch angle of an external thread 38 formed on the bolt shaft 13. Stated in another way, the recessed surface may incline similar to a left handed thread as opposed to the right handed thread 22 in FIG. 12. The upstanding wall 82 is to form part of a stop discussed more in detail below.

The anchoring device 23 is disposed below the drill bit 15 and includes a pair of expansion elements 24 which are designed to be caused to move outwardly from a retracted position as illustrated in the drawings to an expanded condition (not shown) wherein the expansion elements 24 engage the wall 101 of the drilled hole 100.

The expansion elements 24 are interconnected by a connector or a bail strap 25. This connector is typically made from steel and includes a substantially circular body section 26 and connecting legs 27. The connecting legs 27 are riveted (or otherwise fixed) to a proximal end 28 of the expansion elements 24. The expansion elements are joined to the connector to form an anchor assembly. By making the connector 25 from steel, it can flex thereby providing a live hinge that allows pivoting of the expansion elements so as to enable them to easily move between their retracted and their extended position.

Figure 10:
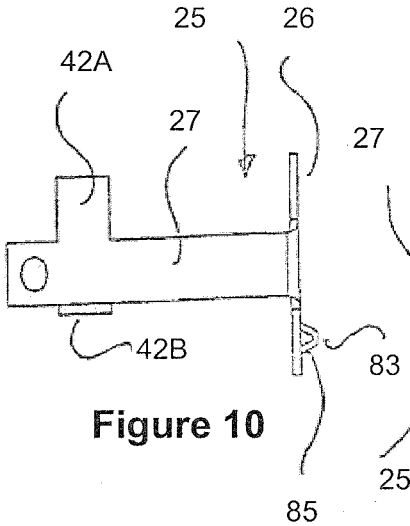
FIG. 10 is a side view of a connector of the drilling tools of FIGS. 1-4 partly in a collapsed condition and partly in an expanded condition.

The body section 26 is preferably substantially circular and comprises a central hole 84 to receive the drill bit shank 18. The body section 26 is provided with at least one projection or upstanding tongue 83 at the surface facing towards the drill bit 15. The tongue 83 is preferably punched out of the body section at a mid-area location, i.e. at a location in between the hole 84 and a periphery of the body section. The tongue 83 has a general V-shape as best seen in FIG. 10 but may have any suitable shape such as a U-shape or semicircular. The tongue has a maximum height that is less than the largest depth of the recessed surface 81. The tongue comprises a leading edge 85, i.e. leading if the connector is rotated in the left hand direction. The leading edge 85 is substantially perpendicular to a plane of the body section 26. The tongue is to be received by the recessed surface 81 and can abut against the upstanding wall 82 during drilling. Thus, the tongue is to form part of the first relative rotation stop means discussed more in detail below.

Figure 9:
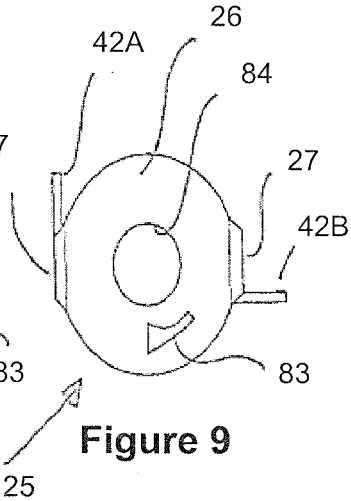
FIG. 9 is a top view of a connector of the drilling tools of FIGS. 1-4 partly in a collapsed condition and partly in an expanded condition.

If the anchoring device is prone to get stuck at the shaft end 20, each leg 27 may carry a second stop or leading tag 42A, 42B, i.e. 'leading' if the connector 25 is rotated in the left hand direction. The tag 42A, 42B is provided adjacent to an end of the leg distal from the body section 26 and is integrated with the connector. In FIGS. 9 and 10 the tag 42A is shown in a retracted position while the tag 42B is shown in an expanded position, for illustrative reasons. Thus, the tag is adapted to be passive during drilling (right hand rotation) but active during anchoring (left hand rotation). The geometries of the tags are optional.

The anchoring device 23 further includes a mandrel 29 which includes opposite inclined surfaces 30 and 31. In the illustrated form, the mandrel 29 includes a head portion 32 and two depending legs 33 and 34 with opposite faces of the head portion 32 and opposite edge surfaces of the legs 33 and 34 forming respective ones of the inclined surfaces 30 and 31. The head portion 32 may have two opposed grooves to house parts of the legs of the connector.

The mandrel is arranged so that the inclined surfaces 30 and 31 are generally flat and designed to abut with inner surfaces 35 of the expansion elements 24 in a manner such that relative movement of the mandrel towards the nut end 12 of the shaft causes the expansion elements to move from their retracted position to their extended position.

To enable this relative movement, the mandrel is coupled to the bolt shaft which in the illustrated arrangement is through a threaded coupling with an internal thread 36 formed in an inner bore 37 in the head portion 32 of the mandrel 29 and an external thread 38 formed on the bolt shaft 13.

The threaded coupling between the mandrel 29 and the bolt shaft 13 is a left handed thread so that when the rock bolt is undergoing a drilling operation (under right hand rotation of the shaft), any relative motion between the mandrel and the shaft would cause the mandrel to move towards the drill end thereby ensuring that the expansion elements are not moved to their expanded condition. However if there is too much movement, the mandrel would force the connector hard against drill bit so that the mandrel could not rotate under left hand rotation thereby preventing activation of the anchor as the mandrel could not wind down the shaft.

To prevent this occurring, the stop is provided by the cooperating abutment surfaces of the upstanding wall 81 and the tongue 83. This stop is active when these two surfaces move into engagement and limits the anchoring device from rotating on the shaft so as to maintain a space between an end surface of the anchoring device and an end surface of the drill bit during drilling.

Figure 13:
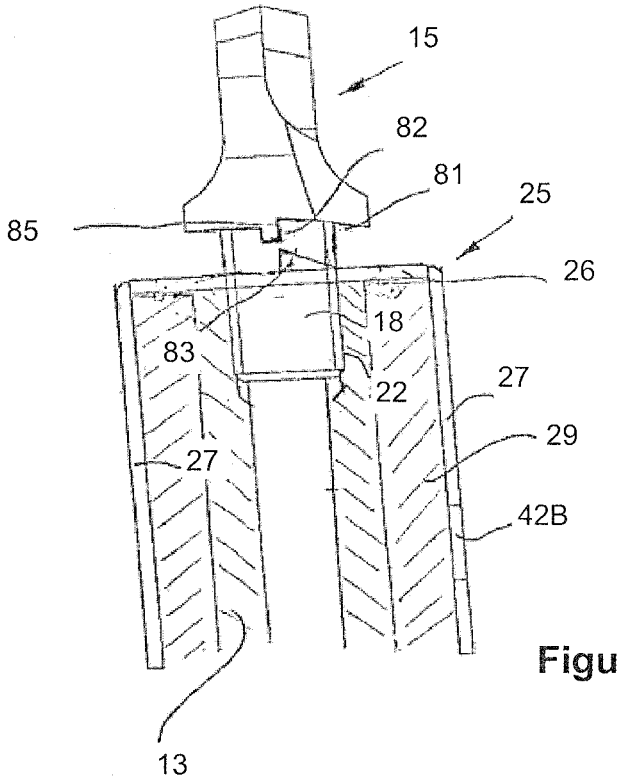
FIG. 13 is a side view of the drilling tools of FIG. 1-4 with the drill bit disengaged with the connector of FIGS. 10 and 11.
Figure 14:
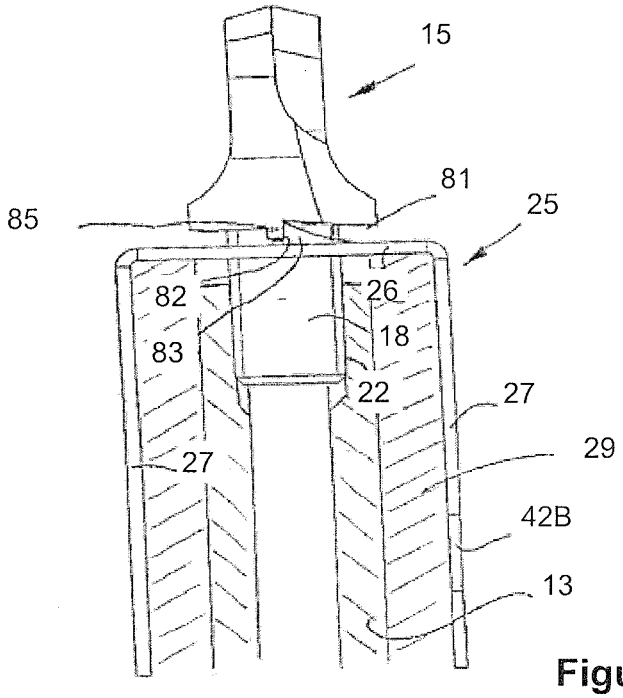
FIG. 14 is the drilling tools of FIG. 1-4 with the drill bit engaged with the connector.

The operation of the stop is best illustrated in FIGS. 13 and 14. As best shown in FIG. 13, a gap is provided between the lower surface 80 of the drill bit 15 and the end of the shaft 13. This gap is large enough so that when the connector is resting on the shaft end the upstanding wall 81 and tongue 83 are disengaged. Therefore the stop is not active and does not prevent any rotation of the mandrel 29 on the shaft. However if the mandrel is caused to wind along the shaft in the direction of the drilling end 11, it will eventually lift the connector off the end of the shaft 13 thereby moving the tongue 83 into engagement with the upstanding wall 81 as shown in FIG. 7B. This causes the stop to become active and prevents further rotation of the mandrel in that direction. Also in that position the connector 25 is still spaced from the lower surface of the drill bit so that the mandrel remains loosely threaded on the shaft.

When the bolt 10 undergoes left hand rotation there is no impediment to the mandrel winding down the shaft as the two abutting surfaces of the stop do not prevent movement of the mandrel in that direction.

The anchoring device 23 may further comprise an annular band, not shown, which can be disposed around a distal end of the expansion elements 24. The annular band is typically made from a polymeric or rubber material and is provided to hold the expansion elements 24 together only during transport and start of drilling.

The tags 42A, 42B of the connector are arranged to adopt two conditions. In the first condition as illustrated in FIG. 8, the tags 42A, 42B are folded towards the mandrel 29. This condition occurs when the tags undergo right hand rotation as would be the case during the drilling operation. In the second condition as best illustrated to the right in FIG. 9, the tags project outwardly from the periphery of the connector 25. This occurs during the opposite rotation of the bolt and is induced by tags passing over the wall surface 101 of the drilled hole under this rotation. When in this second (or expanded) condition, there is a greater tendency for the tags to engage the wall surface of the drilled hole. Once they do grip, the anchoring device begins to slip relative to the shaft thereby inducing some relative movement. This movement, in turn causes the mandrel to start winding down the shaft thereby causing the expansion elements to be displaced outwardly.

Thus, the connector 25 performs several functions. The first function is to hold the expansion elements a set distance axially from the end of the shaft. The second function is to rotationally join the mandrel and the expansion elements together. The third function is to provide a hole so that the drill bit can be threaded into the shaft. The fourth function is to form part of a rotation stop that stops the mandrel from being screwed tightly against the drill bit. The fifth function is to provide tags that grip the bore wall during anchoring, thus allowing the anchoring device to rotate relative to the shaft.

Figure 17:
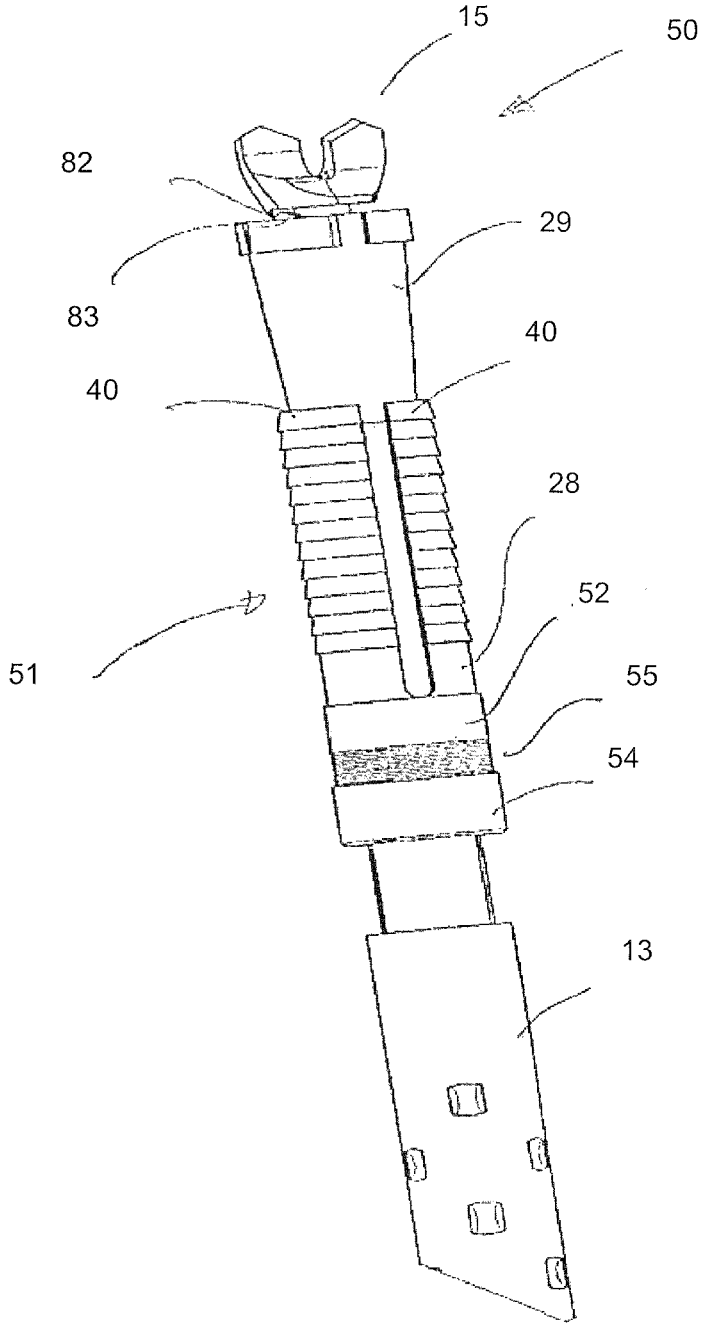
FIG. 17 is a schematic perspective view of a further alternative drilling tool.

Another variation of the rock bolt 10 is illustrated in FIG. 17. The rock bolt 50 includes many of the features of the bolt 10 and like features have been given like reference numerals.

In the bolt 50, an expansion assembly 51 is provided that includes the expansion elements 24 and a collar 52 disposed about the shaft 13 of the bolt 50. The collar 52 functions in the same way as the connector 25 of the earlier embodiment and interconnects the proximal ends 28 of the expansion elements 24.

In contrast to the earlier embodiment, the expansion assembly 51 is orientated so that the distal ends 40 of the expansion elements face towards the drill end 11, rather than the nut end 12 as in the earlier embodiment. To prevent movement of the expansion assembly 51 towards the nut end 12, the assembly 51 is seated on a retaining device 53 that comprises a thrust ring 54 that is axially fixed to the bolt shaft 13 and a slip ring 55 disposed between the thrust ring 54 and the collar 52.

In an arrangement consistent with the earlier embodiment, the assembly 51 incorporates the mandrel 29 arranged so that its inclined surfaces 30 and 31 are designed to abut with inner surfaces 35 of the expansion elements 24. In this way relative rotation between the mandrel 29 and the expansion elements 24 about the shaft axis is inhibited. Further, relative movement of the mandrel 29 towards the nut end 12 of the shaft causes the expansion elements to move from their retracted position to their extended position. Furthermore, the mandrel is coupled to the bolt shaft by a threaded coupling (not shown). The threaded coupling between the mandrel 29 and the bolt shaft 13 is a left handed thread so that when the rock bolt is undergoing a drilling operation (under right hand rotation of the shaft), any relative motion between the mandrel and the shaft would cause the mandrel to move towards the drill end thereby ensuring that the expansion elements are not moved to their expanded condition. Under left hand rotation of the bolt 50 rotation of the expansion element is arranged to occur and whilst not shown, the anchor device 23 may also incorporate the band to promote this rotation. Because the mandrel portion 29 and the expansion assembly 51 rotate together, this rotation is translated to the mandrel 29, to activate the device 23 and cause movement of the mandrel towards the nut end 12.

In a similar manner to the earlier embodiment a stop is provided to prevent excessive movement of the mandrel towards the drill bit. However, in this embodiment the tongue 83 which forms one of the cooperating surfaces of the stop is formed directly on the mandrel 29.

As indicated above with reference to FIGS. 1, 2 and 9, the rock bolt 10 includes a central passage 14 along the shaft 13. The purpose of the passage 14 is to provide at least part of a circulation path to allow fluid to be passed from the nut end 12 to the drilling end 11. The circulation path also includes an outer passage 64 formed between the shaft 13 and the wall 101 of the drilled hole 100. A bearer plate and ball washer 72 may be disposed on the shaft 13 and captured by the drive nut 43. The bearer plate is arranged to bear against the outer face of the rock strata 500.

Before operation, the anchoring device 23 is threaded onto the shaft 13 suitably until the shaft end 20 abuts against the lower side of the body section 26 of the connector 25. Then the drill bit 15 is threaded into the inner thread 21 of the shaft end until a drill bit shank end 86 engages a bottom 87 of the inner thread 21.

In operation, the bolt 10 is secured to a drilling apparatus, via the drive nut 43, which rotates the rock bolt in the first direction. Drilling fluid is pumped around the circulation path, that is, the inner passage 14, and outer passage 64 to flush the rock cutting surface of the rock bolt. The fluid is either introduced or withdrawn from a port in the irrigated drive nut 43.

On completion of the drilling phase, the drilling apparatus then rotates the bolt in the opposite direction. The drive nut 43 rotates with the shaft 13 as relative movement is prevented by a torque pin. This causes the tags 42 (if present) to flare outwards causing the connector to grip the wall surface 101 causing the expansion elements 24 and mandrel 29 to start to slip relative to the bolt shaft. This relative movement induced between the anchoring device and the shaft causes the mandrel to wind down the thread of the shaft thereby causing the expansion elements to displace radially outwardly to engage the rock surface of the drilled hole.

When the expansion elements are engaged with the wall surface, the bolt is placed in tension by continuing to apply torque in the second direction to the drive nut 43. At a particular point, the expansion elements 24 are forced so hard against the rock wall surface that the mandrel cannot move down the shaft any further. This then effectively binds the bolt and inhibits it from rotating any further. This builds up the torque at the drive nut 43 until it reaches a point where it will shear a torque pin thereby letting the drive nut to move relative to the shaft. This relative movement then causes the nut to wind up the shaft.

Once the drive nut is able to move along the bolt shaft, it will then move into engagement the outer face of the rock strata 500 (either directly or through the bearer plate) which will then enable the bolt to be placed in tension as the effective length of the bolt between the drive nut and the anchoring device is shortened. Once the bolt is under sufficient tension, the drilling apparatus can then be removed and possibly for further support a final stage of setting the bolt in place by the introduction of the grout through a port in the drive nut 43 can take place.

Figure 15:
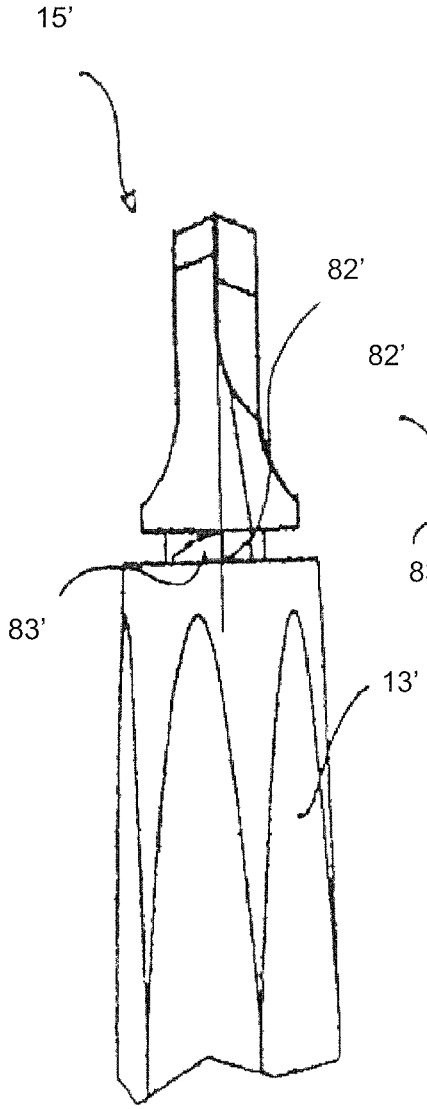
FIG. 15 is a side view of an alternative drilling tool.
Figure 16:
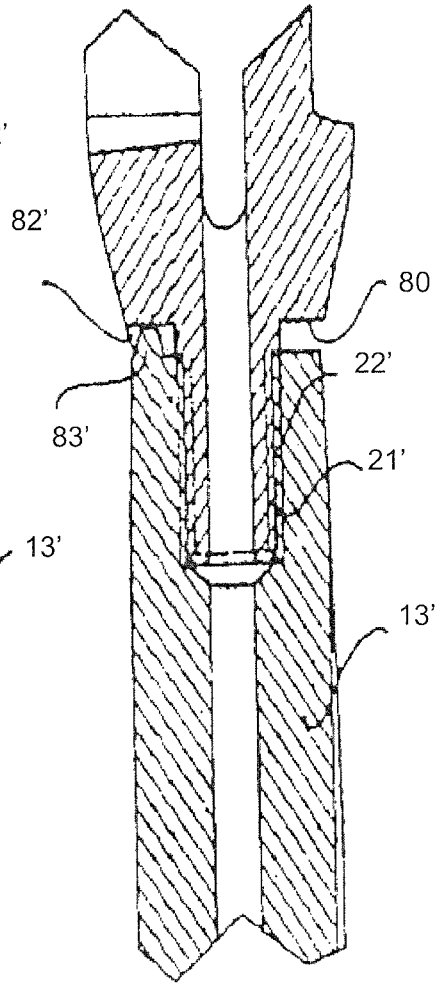
FIG. 16 is a sectional view of the drilling tool in FIG. 15.

In yet another alternative embodiment, as illustrated in FIGS. 15 and 16, the drilling tool comprises first and second ends (the latter not shown), a shaft 13' extending between the ends. The shaft 13' may include a cuttable shaft section similar to that shown in FIGS. 1 and 2. The first end having a drill bit 15' to penetrate rock. The drill bit 15' and the shaft 13' have complementary threads 22' and 21', respectively. A shoulder surface 80' of the drill bit and an end of the shaft comprise a relative rotation stop that ensures that the drill bit remains loose during drilling in a first direction. Here the term "loose" means that the uncoupling torque is not more than 10% of the coupling torque, i.e. there is no need for a wrench or hammer to disassemble the drilling tool, only the use of hand power.

One of the drill bit and the shaft is provided with a projection 83' and the other with a recess 81'. The projection and an upstanding wall 82' of the recess 81' abut to stop relative rotation of the drill bit and the shaft. The threads 21' and 22' are matched such that the projection 83' will enter into the recess 81' to provide a minimum gap between the shoulder surface 80' of the drill bit and the end of the shaft 13'. The projection and the recess have been described more closely above in connection with the previous embodiment.

Figure 18:
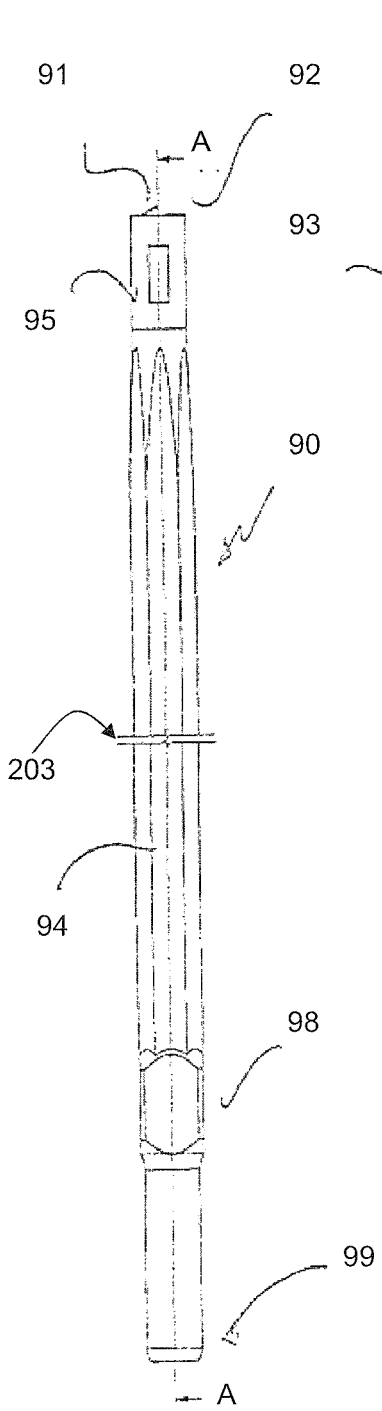
FIG. 18 is a side view of a drill shaft for further alternative drilling tool.
Figure 19:
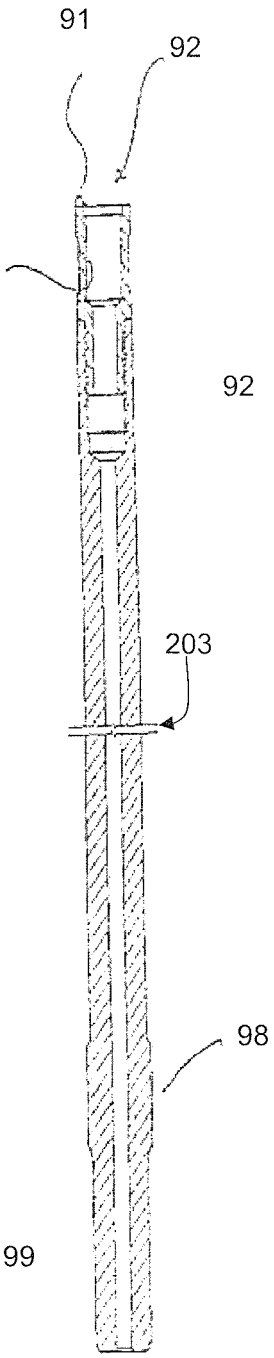
FIG. 19 is a cross-sectional view of the drill shaft of FIG. 18.
Figure 20:
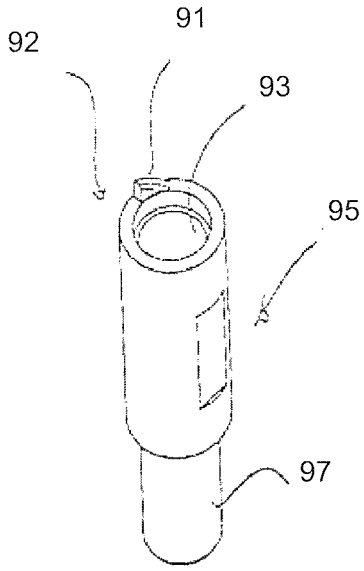
FIG. 20 is a perspective view of an end coupling of the drill shaft of FIG. 18.
Figure 21:
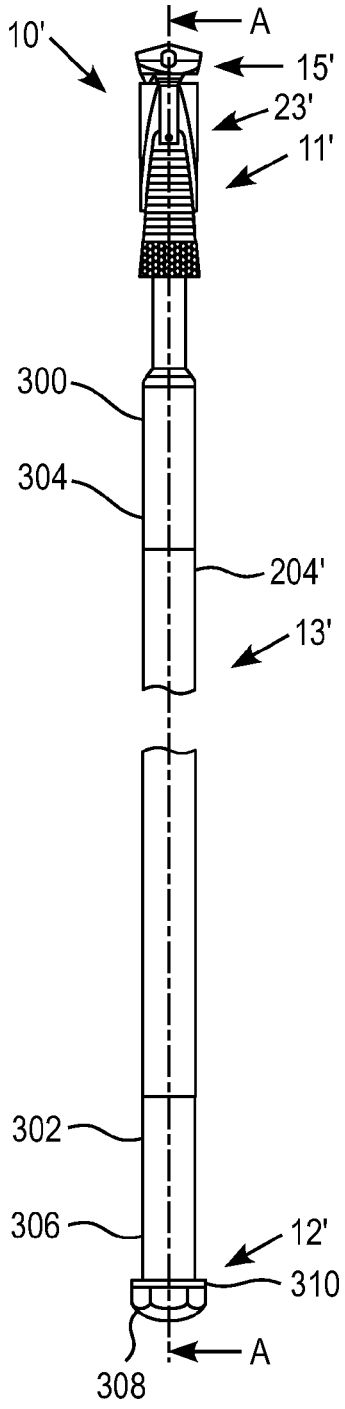
FIG. 21 is a side elevational view of another embodiment of a drilling tool.
Figure 22:
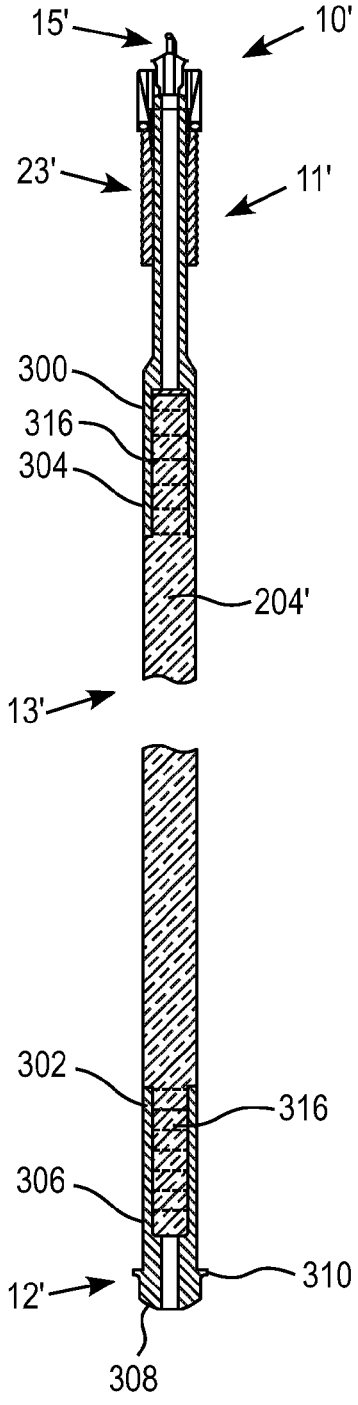
FIG. 22 is a sectional view of the drilling tool shown in FIG. 21.
Figure 23:
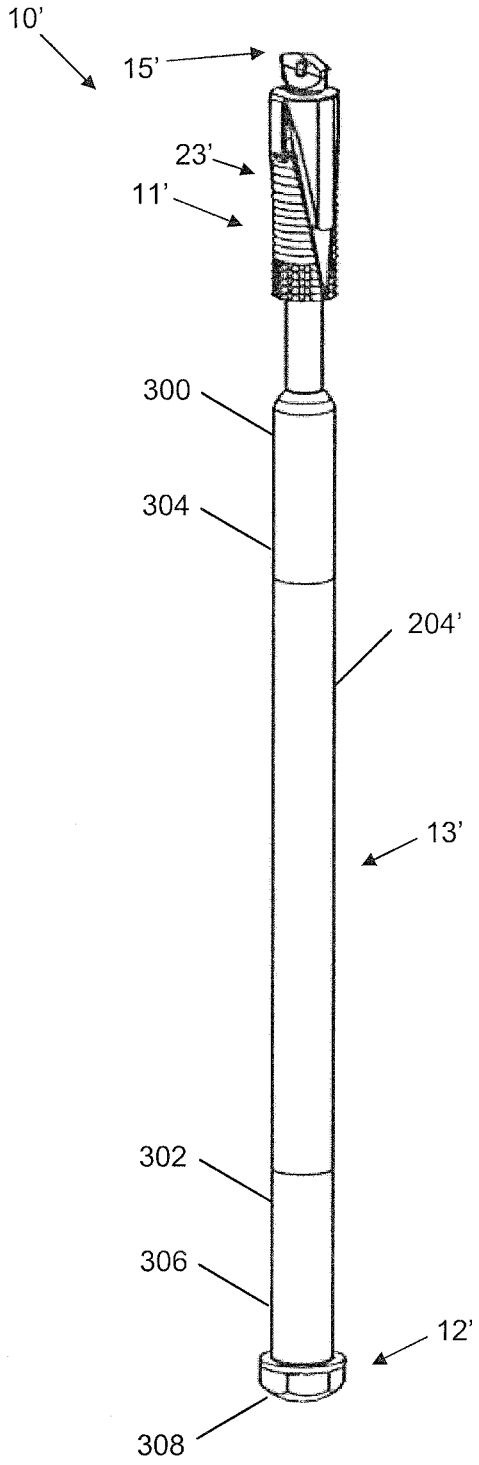
FIGS. 23 and 24 are perspective views of the drilling tool shown in FIG. 21.
Figure 24:
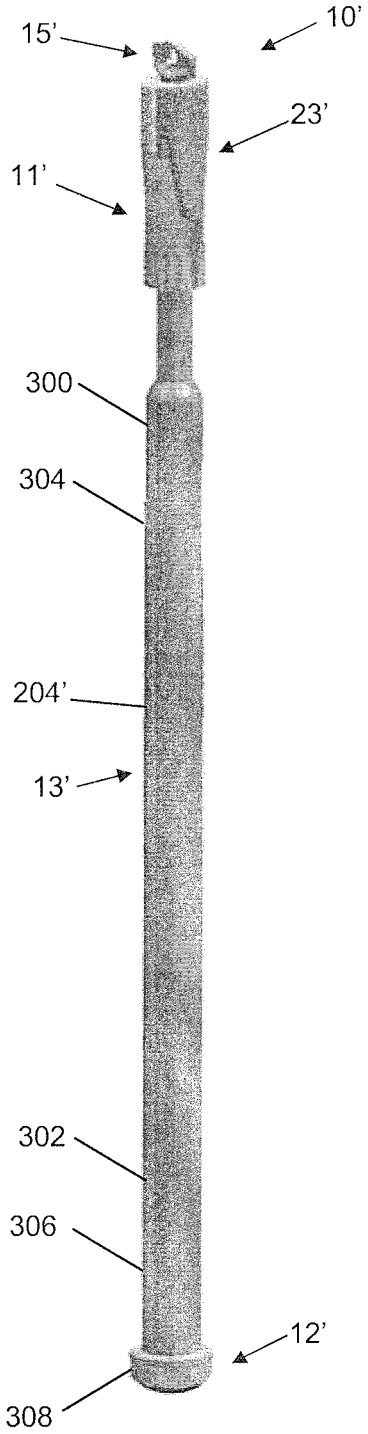

An alternative shaft 90 to the shaft 13' for the drilling tool of FIGS. 15 and 16 is illustrated in FIGS. 18 to 20. The shaft 13' includes a cuttable section between shaft ends. The cuttable section may be crimped or clamped on intermediate the ends 203 as for the tool shown in FIGS. 1 and 2. As in the earlier embodiment, the shaft 90 includes a projection 91 on a first end 92 and incorporates an internal thread 93 which is arranged to receive the threaded shank of the drill bit 15'. In this way, a drilling tool incorporating the shank 90 is able to function in the same way as the drilling tool shown in FIGS. 15 and 16.

However in contrast to the shaft 13' which is made as an integral element, the shaft 90 includes a major portion 94 and an end portion 95. These portions 94 and 95 are axially aligned with the end portion 95 incorporating the threaded coupling 93 to receive the drill bit and the projection 91 on its distal end.

In the illustrated form, the main portion 94 is a conventional drill rod and includes a drive element 98 formed adjacent the second end 99 which is arranged to be connected a drilling apparatus to provide rotation and thrust to the drilling tool. The end portion 95 is in the form of an end coupling incorporates a threaded shank 97 (as best seen in FIG. 20) arranged to screw into a threaded bore 93 provided on the end of the drill rod. This threaded bore 93 is provided to accommodate a drill bit in a conventional drill rod configuration. In this way, the end coupling 95 which is typically formed as a cast component provides a simple arrangement to convert a conventional drill rod into one that can incorporate the stop mechanism as described above. In particular the end coupling 95 can be retro-fitted without requiring any modification to the drill rod.

Figure 25:
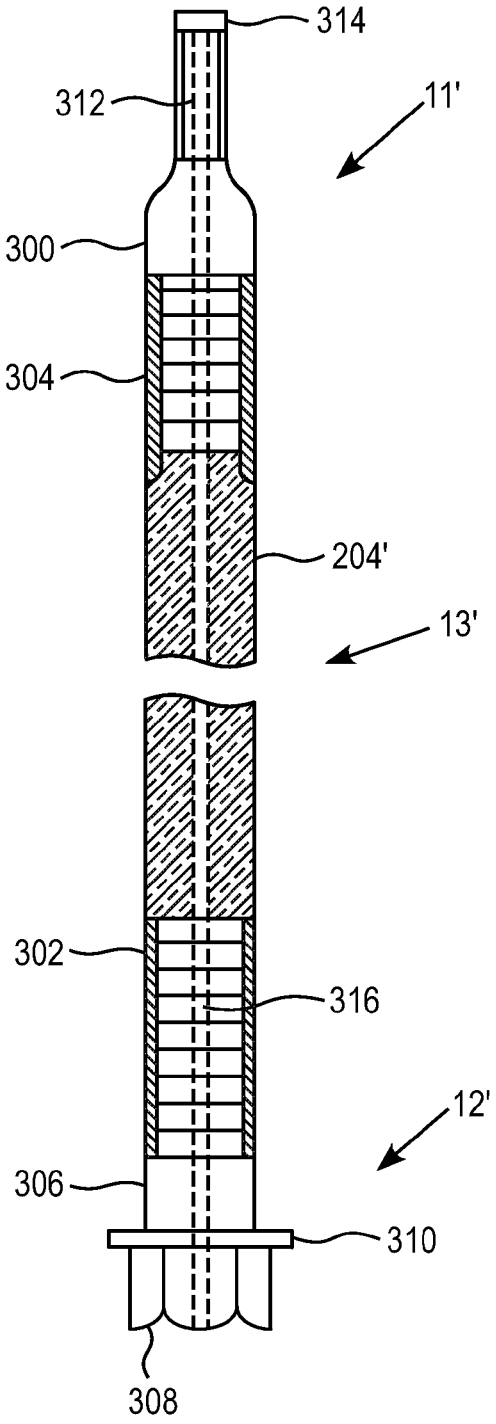
FIG. 25 is a sectional view of part of the drilling tool shown in FIG. 21.

FIGS. 21-25 illustrate another embodiment drilling tool 10' having a shaft 13' incorporating a first (drilling) end 11' and a second (nut) end 12'. The shaft 13' extends between the opposing ends 11' and 12'. The shaft 13' has a shaft section 204' arranged to be cut and/or processed by a mining machine as described above, and in this embodiment is fabricated from a glass reinforced plastic material. This drilling tool 10' includes a connector piece 300 arranged to connect to a drill bit 15. The drill bit is shown in FIGS. 21-24 but not FIG. 25. As shown in FIG. 25, a thread 314 is provided for connection of the connector piece 300 to the drill bit 15'. The connector piece 300 also includes a thread 312 for connecting an anchoring device 23' thereto. The shaft 13' also has a connector piece 306 at the other end 12'. This end 12' includes a nut 308 with an associated support flange 310. The nut 308 facilitates connection of the end 12' to a drilling apparatus. In this embodiment, the connector pieces 300 and 306 each comprise an integrally formed deformable member. In this embodiment, the deformable members 302,304 are metal and are swaged around the shaft section 204' for securement of the connector pieces 300,306 to the shaft section 204'. As seen in the cross sectional view in FIG. 22, this shaft section 204' has grooves such as 316 to facilitate the grip of the deformable member on the shaft section 204' by way of a mechanical interference between the shaft section 204' and the deformable member. In an alternative embodiment one or both of the connectors 300 and 306 have internal threaded surfaces and are screwed onto the ends 11' and 12' of the shaft 13' which has corresponding external threaded surfaces adjacent its ends. This provides attachment of the connectors to the shaft.

In the claims which follow and in the preceding description of relative rotation stop means where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A shaft of a drilling tool extending between opposing ends, one of the ends being associated with a drill bit to penetrate rock, the other end being associated with a drilling apparatus to allow rotation of the shaft, the shaft comprising:

a shaft section fabricated from glass reinforced polymer;

a connector piece fabricated from a metal; and a mechanical joint joining the connector piece to the shaft section, wherein the shaft section has opposing shaft section ends, the shaft section being arranged to be cut and/or processed by a mining machine, wherein the connector piece is mechanically attached adjacent one of the shaft section ends, the connector piece being arranged to connect one of the drill bit, the drilling apparatus or an anchoring device to the shaft section, and wherein the mechanical joint is a deformable member swaged, crimped and/or pressed around both the connector piece and the shaft section to secure the connector piece to the shaft section.

2. The shaft defined by claim 1 wherein the connector piece comprises the deformable member.

3. The shaft defined by claim 2 wherein the shaft section is shaped to provide a mechanical interference between the shaft section and the deformable member.

4. The shaft defined by claim 1 wherein the deformable member overlays the shaft section and the connector piece, and wherein the deformable member extends further along the shaft section than along the connector piece.

5. The shaft defined by claim 1 wherein the connector piece is fitted and/or molded over a portion of the shaft section.

6. The shaft defined by claim 5 wherein the portion of the shaft section may be shaped to provide a mechanical interference between the shaft section and the connector piece.

7. The shaft defined by claim 1 wherein the connector piece may have an external thread.

8. The shaft defined by claim 7 wherein the external thread may be a rope thread.

9. The shaft defined by claim 1 wherein the shaft section comprises a conduit running along the length of the shaft section, the conduit opening out at ends of the shaft section.

10. The shaft defined by claim 1 wherein the connector piece comprises a threaded surface arranged to engage a corresponding threaded surface of the shaft.

11. A drilling tool comprising the shaft defined by claim 1.

12. The drilling tool defined by claim 11 that is a self drilling rock bolt.

13. A self drilling rock bolt comprising:

the shaft defined by claim 1; and an anchoring device extending along a first part of the shaft adjacent one of the ends.

14. The self drilling rock bolt defined by claim 13 wherein the anchoring device has an internal thread that cooperates with an external thread on a connector fitted and/or moulded over a portion of the shaft section, the first part of the shaft having a drill bit to penetrate rock during drilling in a first direction and a stop to limit the rotation of the anchoring device on the shaft to maintain the anchoring device in loose threaded connection on the shaft during drilling.

* * * * *